US006487380B1

(12) United States Patent
Ito

(10) Patent No.: US 6,487,380 B1
(45) Date of Patent: Nov. 26, 2002

(54) IMAGE FORMING APPARATUS HAVING TRANSFER MEMBER FOR CARRYING A RECORDING MEDIUM

(75) Inventor: Yoshikuni Ito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/594,521

(22) Filed: Jun. 16, 2000

(30) Foreign Application Priority Data

Jun. 18, 1999 (JP) ..... 11-172562
Jun. 9, 2000 (JP) ..... 2000-174335

(51) Int. Cl.[7] ..... G03G 15/16
(52) U.S. Cl. ..... 399/66; 399/314
(58) Field of Search ..... 399/299, 303, 399/306, 313, 312, 311, 314, 66

(56) References Cited

U.S. PATENT DOCUMENTS 5,574,550 A * 11/1996 Okazaki et al. ..... 399/313
5,655,200 A * 8/1997 Oyama ..... 399/313
5,701,569 A * 12/1997 Kanazawa et al. ..... 399/308
5,822,667 A * 10/1998 Hayama et al. ..... 399/314
6,134,415 A * 10/2000 Iwakura et al. ..... 399/299
6,173,148 B1 * 1/2001 Matsuda et al. ..... 399/310

* cited by examiner

*Primary Examiner*—Robert Beatty
(74) *Attorney, Agent, or Firm*—Fitzpatrick, Cella, Harper & Scinto

(57) ABSTRACT

An image forming apparatus includes an image bearing member for bearing an image, a recording material bearing member for bearing and feeding a recording material, and a transfer member for electrostatically transferring the image on the image bearing member to the recording material borne on the recording material bearing member while being brought into contact with the back surface of the recording material bearing member, in which voltage applied to the transfer member is larger than voltage applied to the recording material bearing member when a predetermined electric current is supplied to the transfer member while the recording material bearing member is being moved, such that the following relationship holds:

$$900 \leq V \cdot (S \cdot L)/I \leq 4500 \ (kV \cdot mm^2/\mu C)$$

where

I ($\mu$C/sec.) denotes the transfer electric current,

V (kV) denotes the applied transfer bias,

S (mm/sec) denotes the movement speed of the recording material bearing member, and L (mm) denotes the length of the transfer belt in a perpendicular direction to the recording material feeding direction.

8 Claims, 9 Drawing Sheets

IMAGE FORMING APPARATUS HAVING TRANSFER MEMBER FOR CARRYING A RECORDING MEDIUM

BACKGROUND OF THE INVENTION

1. Field of the Invention

The present invention relates to an image forming apparatus using an electrophotographic system. For example, the present invention relates to an image forming apparatus such as a copier, a printer, and a facsimile.

2. Related Background Art

There have conventionally known image forming apparatuses using an electrophotographic system or an electrographic recording system such as a copier, a facsimile, and a printer. For example, an image forming apparatus of electrophotographic system will be described. This type of image forking apparatus obtains an image by uniformly charging a surface of, e.g., a drum-shaped electrophotographic photosensitive member (hereinafter referred to as "a photosensitive drum") used as an image bearing member, then exposing the surface in accordance with image information to form an electrostatic latent image, visualizing this electrostatic latent image with developer (including toner) to form so called a toner image which is a visible image, and subsequently transferring this toner image from the photosensitive drum to a recording material and then fixing it.

Further, various image forming apparatuses having a plurality of image forming portions have been provided which form differently colored toner images in the respective image forming portions and transfer the toner images by sequentially superimposing them on the same recording material to form a color image. In this type of image forming apparatus, a recording material is fed to each image forming portion using an endless recording material bearing member. Such a color electrophotographic image forming apparatus is used for high speed recording in a color copier or the like.

FIG. 1 shows a schematic configuration of an example of an color image forming apparatus using electrophotographic system.

In the image forming apparatus of FIG. 1, first, second, third and fourth image forming portions Pa, Pb, Pc and Pd are provided together. In the respective image forming portions differently colored (cyan, magenta, yellow and black in this example) toner images are separately formed by being subjected to the respective processes of forming a latent image by charging and exposure, of forming a toner image by developing, and of transferring the image. A transfer belt 130 that is a belt-shaped recording material bearing member is provided adjacently to photosensitive drums 3*a*, 3*b*, 3*c* and 3*d* used as the image bearing members provided on the respective image forming portions while being stretched around a driving roller 13 and supporting rollers 14 and 15, and toner images of the respective colors formed on the respective photosensitive drums 3*a* to 3*d* are transferred onto a recording material S borne and fed by the transfer belt 130.

Surfaces of the photosensitive drums 3*a* to 3*d* which the image forming portions Pa to Pd have respectively are uniformly charged with drum chargers 2*a*, 2*b*, 2*c* and 2*d* which are charging means provided on the respective outer peripheries of the photosensitive drums 3*a* to 3*d*. After that, a laser beam emitted from a light source device (not shown) is scanned by turning a polygon mirror 117, the scanned light flux is deflected with a reflecting mirror in a light-guiding means 116 and is further condensed on the generatrix of the respective photosensitive drums 3*a* to 3*d* with an fθ lens to expose them, and latent images according to the image information are formed on these photosensitive drums 3*a* to 3*d*. Additionally, the outer peripheries of the respective photosensitive drums 3*a* to 3*d* are also provided with light exposure lamps 111*a*, 111*b*, 111*c* and 111*d* and electric potential sensors 113*a*, 113*b*, 113*c* and 113*d*, respectively.

Developing devices 1*a*, 1*b*, 1*c* and 1*d* provided along the outer peripheries of the respective photosensitive drums 3*a* to 3*d* are replenished with a given amount of cyan, magenta, yellow and black toner, respectively, as developers by supply devices (not shown) and the respective developing devices 1*a* to 1*d* develop the electrostatic latent images formed on the respective photosensitive drums 3*a* to 3*d* as mentioned above to form a cyan toner image, a magenta toner image, an yellow toner image and a black toner image, which are visible images.

On the other hand, the recording material S is contained in a recording material cassette 10, is supplied from here onto the transfer belt 130 through a plurality of feeding rollers and registration rollers 12, and is borne and fed with the transfer belt 130 so as to be sequentially sent to transfer portions that are opposite to the photosensitive drums 3*a* to 3*d*.

The transfer belt 130 is made of a dielectric material sheet such as polyethylene terephthalate resin sheet (PET resin), polyvinylidene fluoride resin sheet, or polyurethane resin sheet. As the transfer belt 130, an endless belt in which both ends were overlapped and joined together, or a seamless belt is used.

When this transfer belt 130 is turned with the driving roller 13 and it is confirmed the transfer belt 130 is at a given position, the recording material S is fed from the registration rollers 12 to the transfer belt so that the recording material S is fed toward the transfer portion (an opposed portion between the photosensitive drum 3*a* and the transfer belt 130) of the first image forming portion Pa. At the same time, an image writing signal is turned ON and an image formation is performed as described above on the photosensitive drum 3*a* of the first image forming portion Pa at desired timing with reference to this signal. Then, by imparting electric field or charge at the transfer portion on the lower side of the photosensitive drum 3*a* in FIG. 1 with transfer means 24*a*, a toner image of first color formed on the photosensitive drum 3*a* is transferred onto the recording material S.

This transfer causes the recording material S securely borne on the transfer belt 130 by electrostatic attractive force and the recording material S is fed to the second image forming portion Pb and downstream thereof.

As the transfer means 24*a* to 24*d* a non-contact charger such as corona discharge, or a contact charger using a transfer charging member such as a blade, roller or brush is used. The non-contact charger has problems that the charger generates ozone and is weak to variations in temperature and humidity circumstances of the air because of charging through air so that images are not formed stably. On the other hand, the contact charger has merits of being ozoneless, strong against the variations in temperature and humidity circumstances, capable of producing a high quality image, etc.

In the second to fourth image forming portions Pb to Pd, toner images are transferred on the recording material S while being superimposed in the same way as mentioned above. After that, the recording material S to which four colored toner images were transferred is separated from the transfer belt 130 by reducing the electrostatic attractive force by eliminating the residual charge with a separation charger 32, downstream in the feeding direction of the transfer belt 130. Usually, the driving roller 13 is grounded for performing stable separation. Further, as the separation charger 32 a non-contact charger is used because the recording material S is charged before a toner image is fixed thereto.

The recording material S to which four colored toner images have been transferred and which has been separated from the transfer belt 130 is fed to a fixing device 9 by a feeding portion 62 and is heated and pressurized at the fixing device 9 so that mixing of toner images and fixing thereof to the recording material S are performed. The fixing device 9 is composed of a fixing roller 51, a pressure roller 52, heat resistant cleaning members 54 and 55 for cleaning the rollers 51 and 52, respectively, roller heaters 56 and 57 provided in the rollers 51 and 52, respectively, an application roller 50 for applying a mold releasing oil such as dimethyl silicone oil to the fixing roller 51, a reservoir 53 for this oil, and a thermistor 58 which detects the temperature of the surface of the pressure roller 52 to control the fixing temperature.

Thus, the recording material S on which a full color image has been formed is discharged to a discharge tray 63 outside the image forming apparatus. When the transfer is completed, the photosensitive drums 3*a* to 3*d* is removed of residual untransferred toner and cleaned with cleaners 4*a*, 4*b*, 4*c* and 4*d* provided on the outer peripheries of the photosensitive drums 3*a* to 3*d*, respectively, and is subsequently prepared for image formation. Further, toner and other contaminants remaining on the transfer belt 130 are cleaned off with a cleaning web (nonwoven fabric) 19 abutting against the surface of the transfer belt 130.

Next, a transfer portion will be described in detail. In the respective image forming portions Pa to Pd, the configurations of the transfer portions are the same. Thus, the description will be made taking one transfer portion as an example, unless a special explanation on other transfer portions is needed. Incidentally, the indices a to d (as "a" in the photosensitive drum 3*a* of the first image forming portion Pa) which indicate the members denoted by reference symbols including the indices belong to the respective image forming portions, are omitted.

It is conventionally known that when electric current (hereinafter referred to as "transfer electric current") which contributes during transfer is kept constant at a proper level, an image is stabilized. Thus, it is general to perform a constant current control on transfer means so that a constant current can be obtained even when volume resistivity is changed by, for example, sorts (thickness, material and the like) of the recording material S or by moisture absorption conditions.

FIG. 2 shows a schematic cross-sectional view of the vicinity of the transfer portion. As shown in FIG. 2, if electric current in the transfer portion is defined as I ($\mu$A), if the width of the recording material S in a direction (hereinafter referred to as "a thrust direction") perpendicular to the movement direction of the transfer belt 130 is defined as P (cm), and if a movement speed (hereinafter referred to as "a process speed") of the recording material bearing member (transfer belt 130) is defined as v (cm/sec), surface charge density $\rho(\mu C/cm^2)$ on the recording material S is expressed as follows.

$$\rho = I/(P \times v)$$

Transfer is stably carried out by imparting charge having such a constant surface charge density p to the recording material S.

Next, voltage (hereinafter referred to as "transfer voltage") applied to a transfer portion will be described.

As described above, the transfer belt 130 is generally made of a film of so called engineering plastic such as PET (polyethylene terephthalate) or PC (polycarbonate). These plastic films are dielectric members each of which usually has volume resistivity on the order of $10^{16}$ Ωcm and relative permittivity of about 3 to 4.

The transfer means 24 may be a transfer blade (conductive blade) comprising plate-shaped-conductive rubber, or a transfer roller comprising a roller made of a material similar to the conductive rubber. The transfer means 24 has sufficiently low resistance as compared with the transfer belt 130 which plays the role of an electrode. In general, this conductive rubber is a conductor having volume resistivity on the order of $10^6$ Ωcm.

The transfer belt 130 may be an insulator and is compared to a capacitor. If the transfer belt 130 is not being turned, the transfer current is not supplied to the transfer portion. However, when the transfer belt 130 is turning, empty capacitors reach the positions of the transfer means 24 in succession whereby the transfer means 24 charge the transfer belt 130.

That is, although the transfer belt 130 which is not being turned is a capacitor, turning of the transfer belt 130 supplies a constant current to the transfer belt 130 and the transfer belt 130 can be compared to electric resistance.

At this time to a power supply 40 which supplies transfer current in the transfer portion is applied a constant voltage (transfer voltage). FIG. 3 shows a schematic cross-sectional view of the vicinity of the transfer portion. Further, FIG. 4 shows an equivalent circuit of the transfer portion shown in FIG. 3.

Electric resistors which increase transfer voltage in the transfer portion are conventionally the transfer belt 130, the recording material S, the photosensitive drum 3 and the transfer means 24 in the order of higher resistance. In the present specification, the voltage applied to each member is defined as a partial voltage in each portion. Incidentally, the order of the electric resistors in the transfer portion are different from the order mentioned above, depending on the type of the image forming apparatus and the sorts of the recording materials S.

In FIG. 3, since a transfer blade 25 made of a conductive rubber, which configurates the transfer means 24, is not turned (moved) like the transfer belt 130 during image formation, the resistance value accounts for the partial voltage as it is. That is, if the volume resistivity of the transfer blade 25 is defined as $\rho V_{blade}$, if a free length of the transfer blade 25 is defined as L, and if a transfer nip (the width across which the transfer blade 25 is in contact with the transfer belt 130 in the movement direction of the transfer belt 130) is defined as d, resistance $R_{blade}$ of the transfer blade 25 during transfer is expressed as follows.

$$R_{blade} = \rho V_{blade} \cdot L/d$$

On the other hand, the transfer belt 130 is turned during image formation. If the volume resistivity of the transfer belt is defined as $\rho V_{belt}$ and if the thickness thereof is defined as t, resistance $R_{belt}$ in the case where the transfer belt 130 is in stop is expressed as follows:

$$R_{blade} = \rho V_{belt} \cdot t/d$$

Since the transfer belt 130 is actually being turned during operation of image formation, resistance of the transfer belt 130 during turning is lower than resistance during stoppage of the transfer belt 130.

In the image forming apparatus with the above structure, recording materials S having various sizes (length (length in the thrust direction) in a direction perpendicular to the feeding direction of the recording material) can be used. To carry out an appropriate transfer even when image formation is performed on a recording material S of a smaller size than the maximum size with which image formation can be carried out, it is preferable that surface charge density on the recording material S of a small size, which is passed through a transfer portion, is substantially the same as the surface charge density on the maximum size recording material S when the recording material of the maximum size is passed through the transfer portion.

FIG. 5 is a cross-sectional view schematically showing the vicinity of a transfer portion when the recording material S of a small size is passed through the transfer portion.

As shown in FIG. 5, if electric current, which flows through a passing portion of the recording material S, is defined as Ip ($\mu$A), if electric current which is passed through a non-passing portion of the recording material S, is defined as Iq ($\mu$A), if the width of a recording material S of a small size in the thrust direction is defined as p (cm), if the width of the non-passing portion in the thrust direction is defined as q (cm), and if a width of the transfer blade 25 constituting the transfer means 24 in the thrust direction is defined as t (cm), the following equation:

$$\rho = Ip/(p \times v) = I/(t \times v) \quad (1)$$

must be satisfied to equalize the surface charge density on the recording material S of a small size when the recording material S of a small size is passed through the transfer portion to the surface charge density of the maximum size recording material S when the recording material S of the maximum size is passed through the transfer portion as described above. In the above equation (1), v is a process speed (cm/s, the movement speed of the transfer belt (recording material)).

However, since the resistance of the recording material S itself is present in the passing portion, impedance in the passing portion of the recording material S is high as compared with the non-passing portion. Accordingly, the current, which is passed through a passing portion, per unit area is smaller than in a non-passing portion. That is, the surface charge density on the recording material S is small as compared with that in the non-passing portion. Therefore, the surface charge density on the recording material S becomes insufficient and transfer efficiency is decreased. As a result, sufficient image concentration cannot be obtained.

That is, in fact, the above-mentioned relation (1) cannot be obtained. The following relations are obtained instead:

$$Iq/(q \times v) > I/(t \times v) > Ip/(p \times v)$$

The passing portion of the recording material S has insufficient charge density and the non-passing portion thereof has excess charge density.

FIG. 6 shows the equivalent circuit of the transfer portion shown in FIG. 5 when a recording material S of a small size is passed through the transfer portion. The ratio of current Ip which flows to the passing portion of the recording material S to current Iq which flows to the non-passing portion thereof is inversely proportional to the resistance ratio between the passing portion of the recording material S and the non-passing portion thereof. That is, if the resistance of the passing portion of the recording material S is defined as Rp and if the resistance of the non-passing portion thereof is defined as Rq, the following equation is satisfied:

$$Ip:Iq = Rq:Rp$$

This problem is likely to occur particularly in the case where an image is transferred to a recording material S which has been dried under low humidity circumstances (for example, 23° C., 5% RH) to exhibit high resistance. In general, the volume resistivity of the recording material S is varied on the order of from $1\times10^{7}$ to $1\times10^{14}$ Ωcm, depending upon the sorts of the recording material S and temperature and humidity conditions. However, the transfer belt 130 is made of a dielectric resin sheet and the volume resistivity thereof is varied by about 1 to 3 digits, utmost due to the temperature and humidity conditions. Further, in the transfer belt 130 with low volume resistivity, whose resistance is adjusted to a low level by additives, this phenomenon is even more likely to occur.

As described above, when the recording material S of a small size is passed through the passing portion, a large amount of current is supplied to the non-passing portion that has small resistance and current which flows into the passing portion is insufficient thereby to cause a transfer failure.

Further, since excess current which then flows into the non-passing portion of the recording material S flows to the photosensitive drum 3, a so-called transfer memory remains on the photosensitive drum 3 whereby fogging (unnecessary toner adhesion) might take place on an image.

Furthermore, when excess current flows under high temperature and high humidity circumstances, charge is penetrated into the recording material S to charge negative charging toner on the surface of the photosensitive drum 3 to an inverse polarity, thereby causing a transfer failure. As a result, a phenomenon of lowering the image density occurs.

SUMMARY OF THE INVENTION

An object of the present invention is to provide an image forming apparatus which can stably, excellently form images on recording materials of various sizes.

Another object of the present invention will become apparent by reading the following detailed descriptions.

DESCRIPTION OF THE PREFERRED EMBODIMENTS

An image forming apparatus according to the present invention will be described in detail with reference to the accompanying drawings.

Embodiment 1

Figure 1:
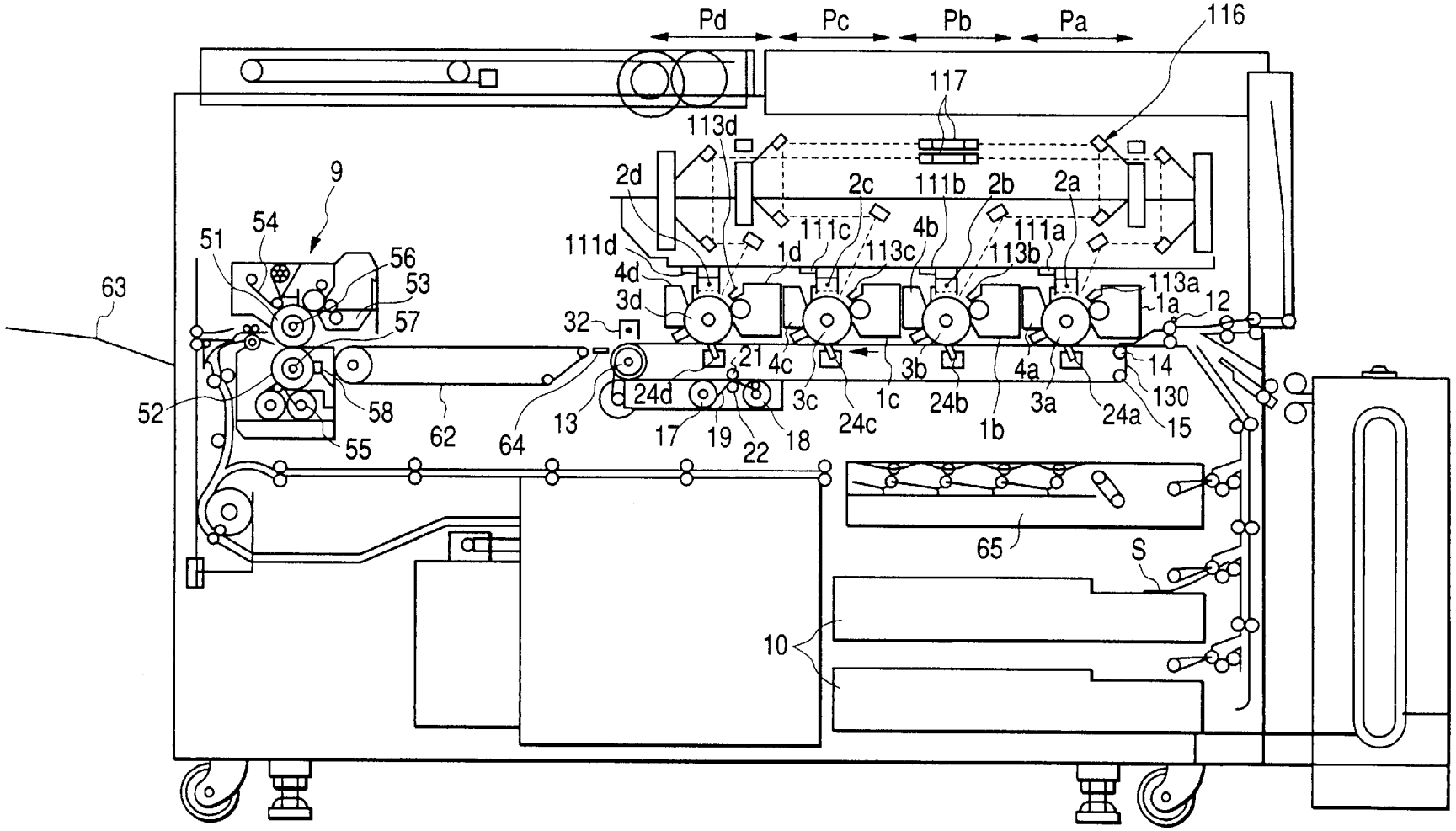
FIG. 1 is a schematic configurational view of an example of an electrophotographic image forming apparatus.
Figure 2:
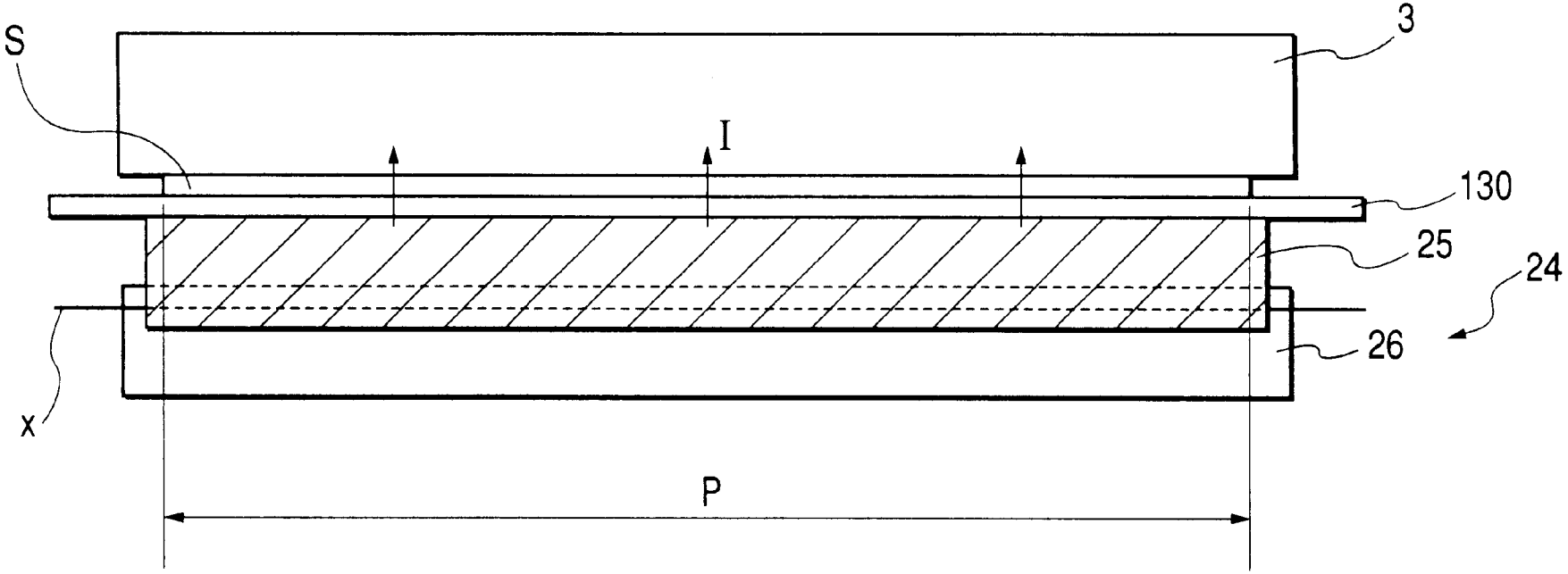
FIG. 2 is a cross-sectional view of a transfer portion.

In the present embodiment, the present invention is applied to an image forming apparatus of FIG. 1 described above. Thus, to members having the same functions are denoted the same reference numerals. If not necessary, overlapped descriptions of the entire image forming apparatus are omitted and feature portions of the present invention will be described below. If necessary, refer to explanations according to FIG. 1.

Incidentally, the application of the present invention is not limited to the image forming apparatus described in the present embodiment. For example, a visible image formed on an image bearing member by using an electrophotographic process or an electrostatic recording process is transferred to a recording material borne on a recording material bearing member to perform image formation. It should be understood that the present invention can be applied to any image forming apparatus, such as a copier, a facsimile, and a printer.

As dielectric sheet materials for the transfer belt 130, film-shaped sheets of engineering plastics such as PET, polyacetal, polyamide, polyvinyl alcohol, polyether ketone, polystyrene, polybutyleneterephthalate, polymethylpentene, polypropylene, polyethylene, polypheniline sulfide, polyurethane, silicone resin, polyamideimide, polycarbonate, polyphenilene oxide, polyether sulfone, polysulfone, aromatic polyester, polyether imide, and aromatic polyimide can be used.

In the case where a conventional transfer belt is used, under low humidity circumstances electrostatic transfer of particularly, a half tone image from a photosensitive drum to a recording material sometimes generated image failure of generating white flower-like pattern in a toner image (toner lost) on the recording material. Particularly, the drier the recording material (a sheet of paper) becomes, the worse the image failure level and incidence become.

It has become apparent from investigations by the present inventors that this phenomenon is generated by electric discharge (electric discharge before transfer) on the upstream side of the transfer portion during transfer of a toner image. That is, drying a recording material increases a resistance value. And when substantially the same transfer electric current is supplied to a transfer charger under the all circumstances, the electric discharge before transfer is likely to be generated by increasing the transfer voltage by the transfer power supply (that is, impedance of the transfer portion is increased). Further, for example, when values of transfer electric current which is supplied to transfer chargers 24*a* to 24*d* are set to the same (constant current control) in a multi-transfer system, the larger increment ΔVtr of the transfer voltage by the transfer power supply corresponding to the transfer charger 24*b* with respect to the transfer voltage by the transfer power supply corresponding to the transfer charger 24*a* becomes the worse the above-mentioned image failure level and incidence becomes.

Thus, in the present embodiment, the above-mentioned image failure can be prevented by decreasing the resistance value of the transfer belt (decreasing the impedance of the transfer portion) and reducing the increment ΔVtr of the above-mentioned transfer voltage.

Volume resistivities of a conventional transfer belt are on the order of $10^{16}$ to $10^{17}$ Ωcm. When the process speed (the movement speed of the transfer belt) is 100 mm/sec and when the transfer electric current is 16 μA, the transfer voltage Vtr (first station) and the increment ΔVtr of the transfer voltage (substantially the same between the first and second stations, between the second and third stations and between the third and fourth stations) are shown in the following Table.

| Material components of transfer belt | Volume resistivity (Ωcm) | Transfer voltage (KV) | ΔVtr (KV) |
|---|---|---|---|
| 1) PI | $10^{17}$ | 4 | 0.8 |
| 2) PI + carbon dispersion | $10^{15}$ | 2.4 | 0.2 |
| 3) PI + carbon dispersion | $10^{13}$ | 1.8 | 0.1 |

In the above Table, PI is polyimide resin. As shown in Table the smaller the volume resistivity of the transfer belt becomes the smaller ΔVtr becomes.

Further, the occurrence circumstances of image failure with respect to the dynamic impedance MΩ are shown in the following Table.

| Material components of transfer belt | Dynamic impedance (MΩ) | Image failure |
|---|---|---|
| 1) PI | 250 | x (occurred) |
| 2) PI + carbon dispersion | 150 | ○ (not occurred) |
| 3) PI + carbon dispersion | 112.5 | ○ (not occurred) |

As described above, it can be seen that in the case of a process speed of 100 mm/sec, the image failure can be prevented at a dynamic impedance of 150 MΩ or less. Further, if the thrust width of the transfer charger (the length in a direction perpendicular to the movement direction of the transfer belt) is defined as 300 mm, charge density σs (μC/mm$^2$) on a transfer belt by the transfer electric current satisfies the following equation:

$$\sigma s = \text{transfer current}/(\text{process speed} \times \text{thrust width}) = 5.33 \times 10^{-4}$$

Thus, to eliminate the dependence of the process speed, Vtr/σs is defined in place of the dynamic impedance as shown in the following Table:

| Material components of transfer belt | Dynamic impedance (MΩ) | Vtr/σs [kv · mm²/μC] |
|---|---|---|
| 1) PI | 250 | 7500 |
| 2) PI + carbon dispersion | 150 | 4500 |
| 3) PI + carbon dispersion | 112.5 | 3375 |

That is, if an expression Vtr/σs≦4500 is satisfied, the occurrence of image failure can be prevented.

Further, if the resistance of the transfer belt is too low, a phenomenon occurs that transfer electric current to be supplied toward a photosensitive drum flows by passing through the back of the transfer belt. According to the study of the present inventors, if the volume resistivity of the transfer belt is $10^9$ Ωcm or less, the above-mentioned phenomenon occurs. Therefore, it is preferable that the lower limit value of the volume resistivity of the transfer belt in the present embodiment is $10^{10}$ Ωcm or more. That is, it is preferable that the expression Vtr/σs≧900 is satisfied. This is because the dynamic impedance of the transfer portion is the order of $10^9$Ω and the impedance in a direction of the photosensitive drum and the impedance in a direction to be passed through the back of the transfer belt when viewed from the transfer power supply become the same so that the transfer electric current flows in two directions.

Thus, in the present embodiment a transfer belt made of polyimide resin was used from the viewpoints of mechanical properties, electrical properties and incombustibility and the like. Specifically, inconsideration of increase in a resistance value by drying a recording material, a seamless transfer belt with a volume resistivity of $10^{13}$ Ωcm and a thickness of 100 μm was used. Additionally, the transfer belt with a thrust width of 31 cm was used.

Figure 3:
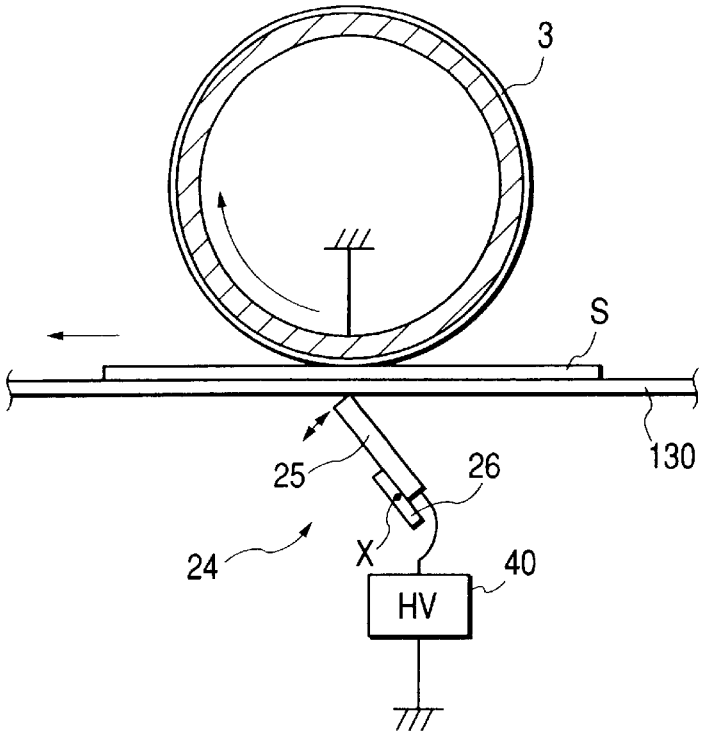
FIG. 3 is a cross-sectional view of a transfer portion of an embodiment according to the present invention.
Figure 4:
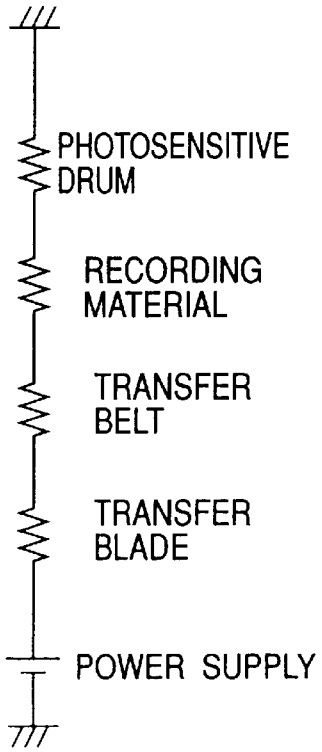
FIG. 4 is a view showing an equivalent circuit of the transfer portion of FIG. 3.

FIG. 3 shows a schematic cross-sectional view of the vicinity of a transfer portion of an image forming apparatus of the present embodiment.

According to the present embodiment, transfer means 24 includes a transfer blade 25 made of conductive rubber extended in a direction (a width in the thrust direction is 30 cm) perpendicular to the feeding direction (a movement direction of a transfer belt 130, the direction being indicated by an arrow) of a recording material S, and a support rocking member 26 which supports this transfer blade 25 and rocks it in the feeding direction of the recording material S so as to allow this transfer blade 25 to be separated from and to be brought into contact with a photosensitive drum 3 through the transfer belt 130.

The transfer blade 25 is connected to a constant electric current power supply 40, and the top end of the transfer blade 25 is pressurized by the support rocking member 26 so that it comes into contact with the photosensitive drum 3 through the transfer belt 130.

In consideration of variations of positions in the thrust direction on the passage of the recording material S, the length in the thrust direction of the transfer blade 25 constituting the transfer means 24 may be made slightly longer than the width in the thrust direction of the recording material S of the maximum size (a size of A3 in the present invention) so that an image formable (usable) recording material S of the maximum size can be covered. Further, the transfer blade 25 has a volume resistivity of $10^8$ Ωcm and a free length of 20 mm.

As described above, the support rocking member 26 is provided so as to allow the transfer blade 25 to be separated from and to be brought into contact with the photosensitive drum 3 through the transfer belt 130, and rocks the transfer blade 25 about the rocking axis X. The support rocking member 26 pressurizes the transfer blade 25 during image formation so that the transfer blade 25 is brought into contact with the photosensitive drum 3 through the transfer belt 130. That is, the support rocking member 26 pressurizes the transfer belt 130 to sandwich the recording material S and the transfer belt 130 between the photosensitive drum 3 and the transfer blade 25. During non-image formation and when the image forming apparatus is jammed with a recording material S (at the paper jamming), the support rocking member 26 relieves pressure so that the transfer blade 25 is not in contact with the photosensitive drum 3 through the transfer belt 130.

In this embodiment, the support rocking member 26 is capable of rocking the transfer blade 25 so that the .transfer blade 25 can be separated from and be brought into contact with the photosensitive drum 3 through the transfer belt 130. However, the present invention is not limited to this configuration. The configuration of an image forming apparatus to which the present invention is applied does not always need such rocking.

The transfer means 24 has the transfer blade 25 and transfers a toner image formed on the surface of the photosensitive drum 3 to the surface of a recording material S by applying voltage of a polarity opposite to the normal charging polarity of the toner from the power supply 40 to the transfer blade 25.

In the present embodiment the process speed, that is, the movement speed of the transfer belt 130 (recording material) was set to 100 mm/sec, and the transfer electric current was set to 10 μA for the constant current control. The peripheral speed of the photosensitive drum 3 in a transfer portion is substantially the same as in the process speed. A width of the contact region between the surface of the photosensitive drum 3 and the transfer belt 130 (the recording material S intervenes therebetween during transfer) was set to 50 μm. In this case, the width of the contact region is in the feeding direction of the recording material S.

The respective partial voltages in the case where the transfer means 24 and the transfer belt 130 structured as above were used were measured as follows. However, an image transfer is not performed during measuring.

Figure 7A:
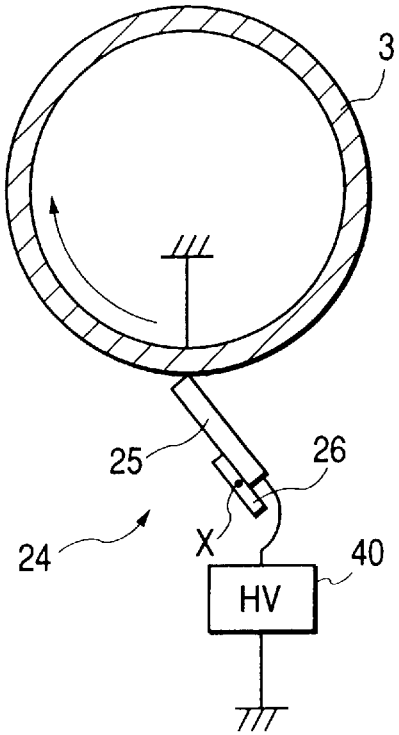
FIG. 7A is a view showing a partial voltage measuring method for transfer means.
Figure 7B:
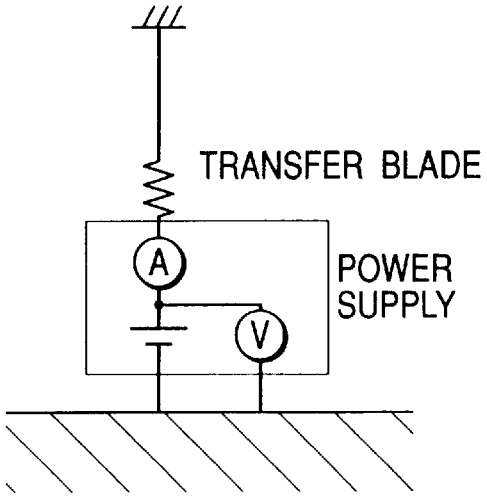
FIG. 7B is a view showing an equivalent circuit of a transfer portion during measuring of partial voltage for the transfer means shown in FIG. 7A.

FIG. 7A shows a partial voltage measuring method for the transfer means 24, and FIG. 7B shows an equivalent circuit of a transfer portion during measuring of partial voltage of the transfer means 24 shown in FIG. 7A.

That is, as shown in FIG. 7A, when partial voltages of the transfer means 24 are measured, the transfer belt 130 is removed, and a photosensitive layer-removed aluminum drum is used in place of the photosensitive drum 3 to ground. Operations other than these operations were performed using the same conditions during image transfer. That is, the state shown in FIG. 7A has an equivalent circuit shown in FIG. 7B. Partial voltage of the transfer means 24 obtained when required current is supplied to the transfer means 24 can be measured with a voltmeter shown in FIG. 7B.

Figure 8A:
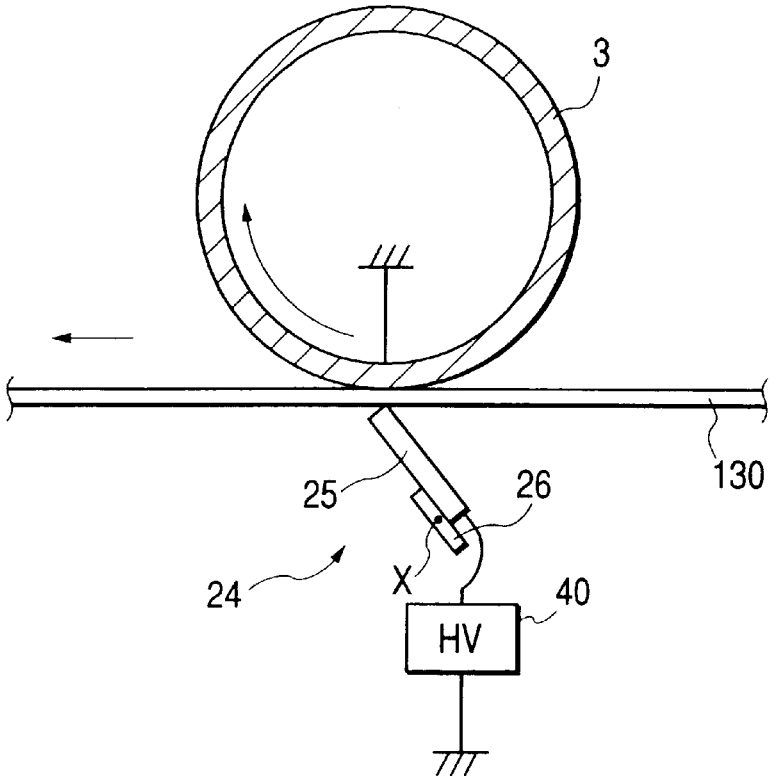
FIG. 8A is a view showing a partial voltage measuring method for a transfer belt.
Figure 8B:
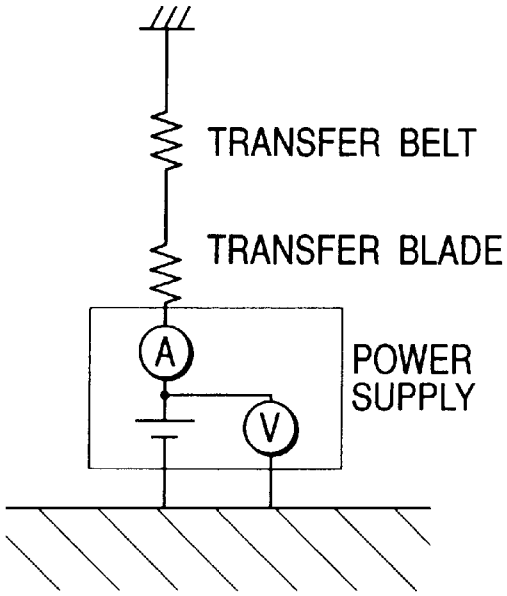
FIG. 8B is a view showing an equivalent circuit of a transfer portion during measuring of partial voltage for the transfer belt shown in FIG. 8A.

FIG. 8A shows a partial voltage measuring method for the transfer belt 130, and FIG. 8B shows an equivalent circuit of a transfer portion during measuring of partial voltage of the transfer belt 130 shown in FIG. 8A.

That is, when partial voltages of the transfer belt 130 are measured, the transfer belt 130 is provided as in the case of usual transfer, and a photosensitive layer-removed aluminum drum is used in place of the photosensitive drum 3 to ground. That is, the state shown in FIG. 8A has an equivalent circuit shown in FIG. 8B. Thus, the sum of the partial voltages of the transfer means 24 and the transfer belt 130 can be measured as in the above-mentioned method. And a partial voltage of the transfer belt 130 can be obtained by subtracting the partial voltage of the transfer means 24 measured as described above from the measured value.

In a state where the above-mentioned aluminum drum (and the transfer belt 130) are turned as in transfer, a partial voltage of the transfer means 24 of 1.2 kV and a partial voltage of the transfer belt 130 of 1.0 kV were measured by the above-mentioned method.

Further, the photosensitive drum actually includes a photosensitive layer on an aluminum cylinder. The photosensitive drum is controlled at a constant surface electric potential in an actual image forming process, but it does not influence on the partial voltages mentioned above. By a drum electric potential 0 V measured in the aluminum drum and the surface electric potential (for example, −700 V) of the photosensitive drum in an image forming process, the transfer voltage by the transfer power supply is shifted. However, partial voltages applied to the recording material, the transfer belt and the transfer charger are not shifted.

Figure 9A:
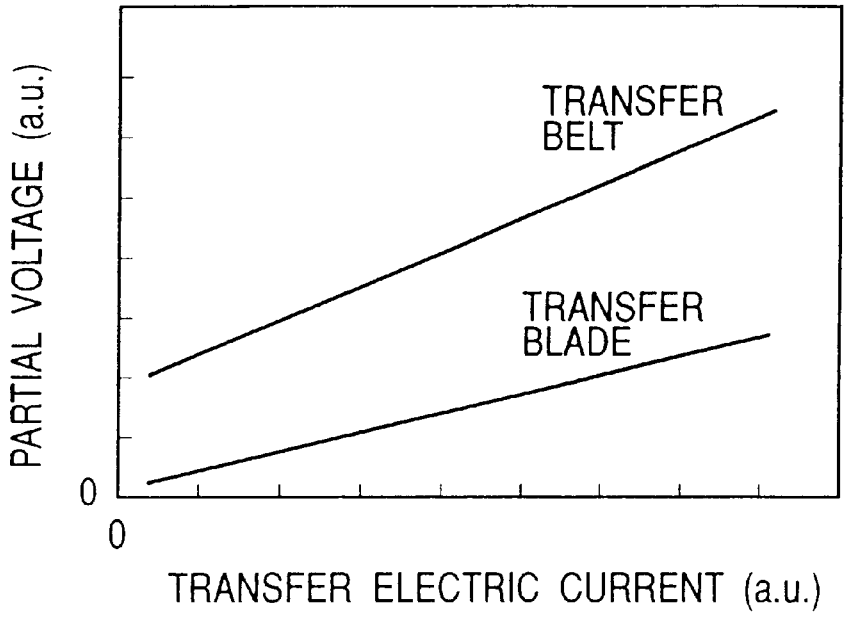
FIG. 9A PRIOR ART
FIG. 9A is a graph showing partial voltages of a transfer belt and transfer means with respect to transfer electric current which flows in a transfer portion of a conventional image forming apparatus.
Figure 9B:
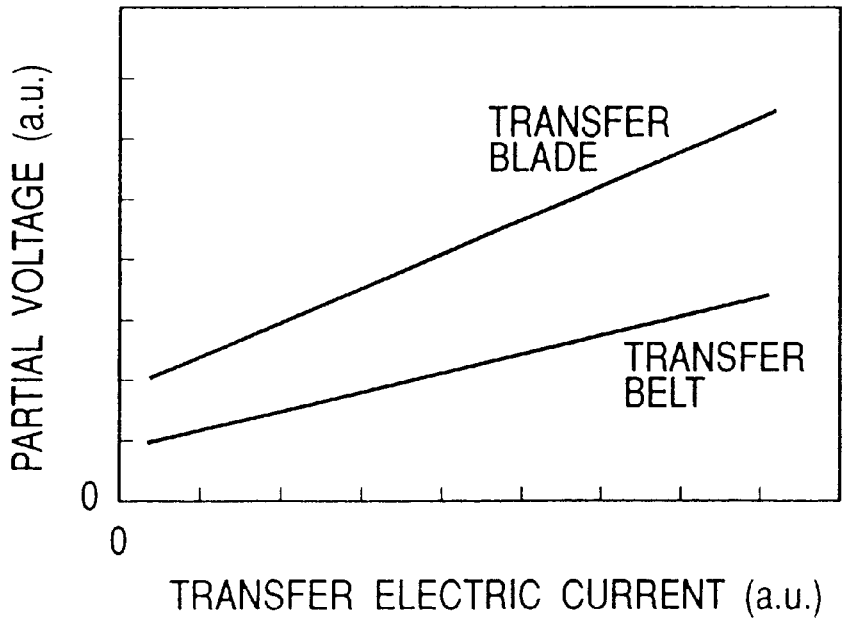
FIG. 9B is a graph showing partial voltages of a transfer belt and transfer means with respect to transfer electric current which flows in a transfer portion of an image forming apparatus according to the present invention.

FIGS. 9A and 9B show a relationship between transfer electric current which flows to a transfer portion and partial voltages of the transfer belt 130 and the transfer means 24. Particularly, FIG. 9A shows that the partial voltage of the transfer belt 130 is larger than the partial voltage of the transfer means 24 in a conventional image forming apparatus. On the contrary, according to the present invention the partial voltage of the transfer means 24 is made larger than the partial voltage of the transfer belt 130 as shown in FIG. 9B.

In an image forming apparatus of the present embodiment, a post card (a width of 10 cm in the thrust direction) left under low humidity circumstances which are the severest conditions (high resistance and small size) for a recording material S of a small thrust width was passed through a transfer portion. As a result, the resistance ratio between a passing portion and a non-passing portion was as follows:

$$Rp:Rq=3:1$$

An image formation was performed on the post card in the image forming apparatus of the present embodiment having the above-mentioned configuration. As a result, sufficient transfer efficiency could be obtained at transfer electric current and transfer voltage lower than in a case of a conventional image forming apparatus. Further, a transfer memory on the photosensitive drum 3 by supplying excess electric current to the non-passing portion was not generated.

A partial voltage of the post card was measured under said conditions using a transfer charger whose thrust width is the same as the width of the post card. The partial voltage measured was 2.0 kV. A partial voltage of the post card measured under said conditions using a transfer charger whose thrust width is 300 mm was 1.0 kV. That is, a partial voltage of the transfer charger measured under the same conditions is smaller than a partial voltage of a recording material (post card).

As described above, in the image forming apparatus of the present embodiment, the volume resistivity of the transfer means 24 was increased by using a conductive rubber having a volume resistivity of about $10^8$ Ωcm in place of a conventional conductive rubber having a volume resistivity of about $10^6$ Ωcm used as the transfer blade 25, whereby the resistance of the entire transfer portion was increased so that the resistance ratio between the passing portion and the non-passing portion of the recording material S was decreased. That is, by setting the partial voltage of the transfer means 24 during transfer to a level larger than the partial voltage of the transfer belt 130, the transfer electric current flowing when a recording material S of a small size is passed through a transfer portion becomes easier to flow into a passing portion of the recording material S as compared with a conventional image forming apparatus.

Particularly, the recording material S of a small size left under low humidity circumstances has a significantly high volume resistivity. However, even in such a case, a surface charge density of the recording material S of a small size can be set to substantially the same as that of the recording material S of the maximum size.

Therefore, for example, when transfer is carried out on a high resistive recording material S of a small size such as a post card left under low humidity circumstances, or when an image is formed on the second side in the two-sided image formation, an appropriate amount of charge can be provided on the recording material S. Further, the entire transfer electric current required for providing the appropriate amount of charge on the recording material S can be decreased. As a result, the electric current which flows to the non-passing portion of the recording material S is reduced, whereby flow of excess current to the photosensitive drum 3 can be prevented.

Further, by preventing the flow of the excess current into the photosensitive drum 3, transfer failure due to charging toner on the photosensitive drum 3 to the inverse polarity can also be prevented.

Furthermore, the difference in potential between the front surface and back surface of the transfer belt 130 is decreased by increasing the resistance value of the transfer means 24 and decreasing the resistance value of the transfer belt 130. Accordingly, this is advantageous for prevention of the image fluctuation due to various electrical discharges.

As described above, according to the present invention, by setting the partial voltage of the transfer means 24 to a level larger than the partial voltage of the transfer belt 130, the resistance ratio between the passing portion and the non-passing portion of the recording material S can be decreased in the transfer portion even when image formation is carried out on a recording material S of a size smaller than the largest possible size of the recording material for image formation. Therefore, an appropriate amount of charge can be stably provided on the recording material S in the image formation on the recording material S having a width equal to or less than the width of the largest possible size of the recording material for image formation without being influenced by the values of physical properties of the photosensitive drum 3, the transfer belt 130 and the recording material S which are always varied by, for example, the placement circumstances of the image forming apparatus and the circumstances in which the recording material S is left.

Embodiment 2

An image forming apparatus of the present embodiment is basically the same as the image forming apparatus of Embodiment 1 except for only the configuration of the transfer means 24.

Figure 10:
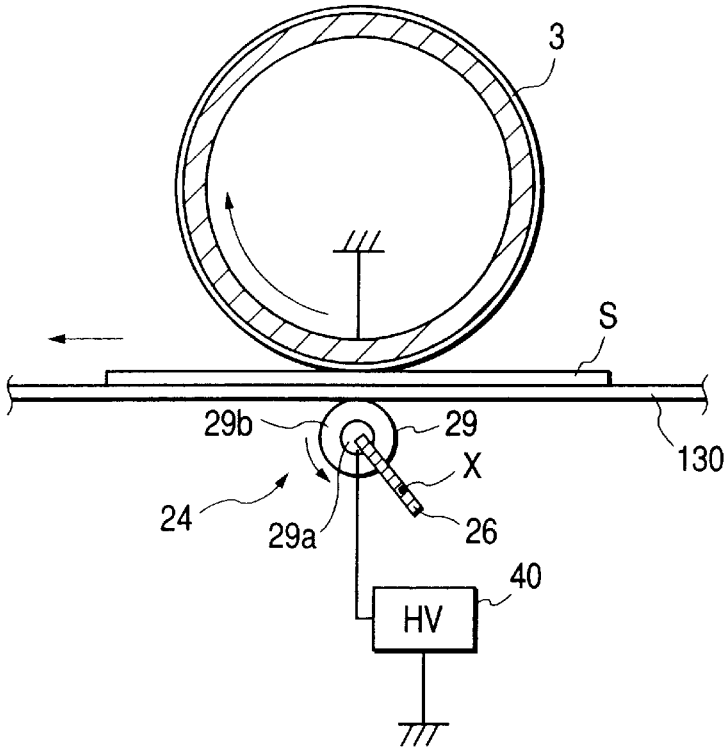
FIG. 10 is a cross-sectional view of a transfer portion of another embodiment of the present invention.

FIG. 10 shows a schematic cross-sectional view of a transfer portion of an image forming apparatus of the present embodiment. In the image forming apparatus of Embodiment 1 the transfer means 24 was formed by using the transfer blade 25 made of a conductive rubber material. However, in the present embodiment (Embodiment 2), as shown in FIG. 10, a transfer rotatable roller 29 made of a conductive rubber material is used.

According to Embodiment 2, the transfer roller 29 is connected to a power supply 40 and is supported by a support rocking member 26. The transfer roller 29 is rocked by the support rocking member 26 as in Embodiment 1 and can be separated from and be brought into contact with the photosensitive drum 3 through a transfer belt 130.

Incidentally, the present invention is not limited to a configuration in which the transfer roller 29 can be rocked, and rocking may not be needed depending on the configuration of the image forming apparatus.

In the present embodiment the transfer roller 29 is composed of a metallic core 29*a* and a conductive rubber layer 29*b* provided around the core 29*a*. A rubber layer 29*b* having a volume resistivity of $10^{11}$ Ωcm and a thickness of 20 mm was used.

In the present embodiment the process speed was set to 100 mm/sec and the transfer electric current was set to 10 μA so that the constant current control was performed.

The partial voltages of the transfer means 24 and the transfer belt 130 of the present embodiment were measured in the same measuring method as in Embodiment 1 described above. The partial voltages of the transfer means 24 and the transfer belt 130 were 1.1 kV and 1.0 kV respectively. Thus, the present embodiment is configured so that the partial voltage of the transfer means 24 is set to a level larger than that of the transfer belt 130 during transfer. The transfer roller is rotated at substantially the same speed as in image transfer during measuring the partial voltages.

Image formation was performed on post cards left under low humidity circumstances in the image forming apparatus having the above-mentioned configuration of the present embodiment. As a result, sufficient transfer efficiency could be obtained. Further, a transfer memory on the photosensitive drum 3 due to excess current supplied to the non-passing portion was not generated.

Further, in the present embodiment, other effects described in Embodiment 1 can be also obtained.

As described above, according to the present invention, by setting the partial voltage of the transfer means 24 to a level larger than the partial voltage of the transfer belt 130 in the case where the transfer means 24 is configured using the transfer roller 29, the resistance ratio between the passing portion and the non-passing portion of the recording material S can be also decreased in the transfer portion even when image formation is carried out on a recording material S of a size smaller than the largest possible size of the recording material S for image formation. Therefore, an appropriate amount of charge can be stably provided on the recording material S in the image formation on the recording material S having a width equal to or less than the width of the largest possible size of the recording material S for image formation without being influenced by the values of physical properties of the photosensitive drum 3, the transfer belt 130 and the recording material S which are always varied by, for example, the placement circumstances of the image forming apparatus and the circumstances in which the recording material S is left.

Embodiment 3

An image forming apparatus of the present embodiment is basically the same as the image forming apparatus of Embodiment 1 except for only the configuration of the transfer means.

Figure 11:
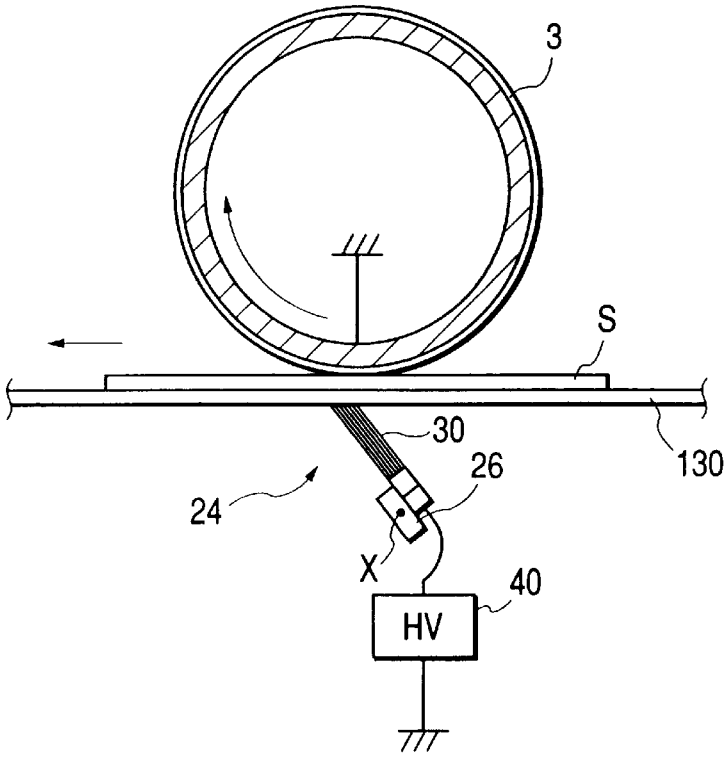
FIG. 11 is a cross-sectional view of a transfer portion of still another embodiment of the present invention.

FIG. 11 shows a schematic cross-sectional view of a transfer portion of an image forming apparatus of the present embodiment. As shown in FIG. 11, in the present embodiment, transfer means 24 is configured by using a transfer brush 30 made of a conductive material.

According to Embodiment 3, the transfer brush 30 is connected to a power supply 40 and is supported by a support rocking member 26. The transfer brush 30 is rocked by the support rocking member 26 as in Embodiment 1 and can be separated from and be brought into contact with the photosensitive drum 3 through a transfer belt 130.

Incidentally, the present invention is not limited to a configuration in which the transfer brush 30 can be rocked, and rocking may not be needed depending on the configuration of the image forming apparatus.

In Embodiment 3, the transfer brush 30 having a brush volume resistivity of $10^8$ Ωcm and a free length of 20 mm was used.

In the present embodiment, the process speed was set to 100 mm/sec and the transfer electric current was set to 10 μA so that the constant current control was performed.

The partial voltages of the transfer brush 30 and the transfer belt 130 of the present embodiment were measured in the same measuring method as in Embodiment 1 described above. The partial voltages of the transfer brush 30 and the transfer belt 130 were 1.2 kV and 1.0 kV respectively. Thus, the present embodiment is configured so that the partial voltage of the transfer means 24 is set to a level larger than that of the transfer belt 130 during transfer.

Image formation was performed on post cards left under low humidity circumstances in the image forming apparatus having the above-mentioned configuration of the present embodiment. As a result, sufficient transfer efficiency could be obtained. Further, no transfer memory on the photosensitive drum 3 due to excess current supplied to the non-passing portion was generated.

Further, in the present embodiment, other effects described in Embodiment 1 can be also obtained.

As described above, according to the present invention, by setting the partial voltage of the transfer means 24 to a level larger than the partial voltage of the transfer belt 130 in the case where the transfer means 24 is configured using a transfer brush 30, the resistance ratio between the passing portion and the non-passing portion of the recording material S can be also decreased in the transfer portion even when image formation is carried out on a recording material S of a size smaller than the largest possible size of the recording material for image formation. Therefore, an appropriate amount of charge can be stably provided on the recording material S in the image formation on the recording material S having a width equal to or less than the width of the largest possible size of the recording material for image formation without being influenced by the values of physical properties of the photosensitive drum 3, the transfer belt 130 and the recording material S which are always varied by, for example, the placement circumstances of the image forming apparatus and the circumstances in which the recording material S is left.

Embodiment 4

In the above-mentioned respective embodiments, a recording material bearing member was described as a transfer belt 130 stretched around a plurality of rollers. However, the present invention is not limited to this. In Embodiment 4, a case where the present invention was applied to an image forming apparatus using so called a transfer drum will be described.

Figure 12:
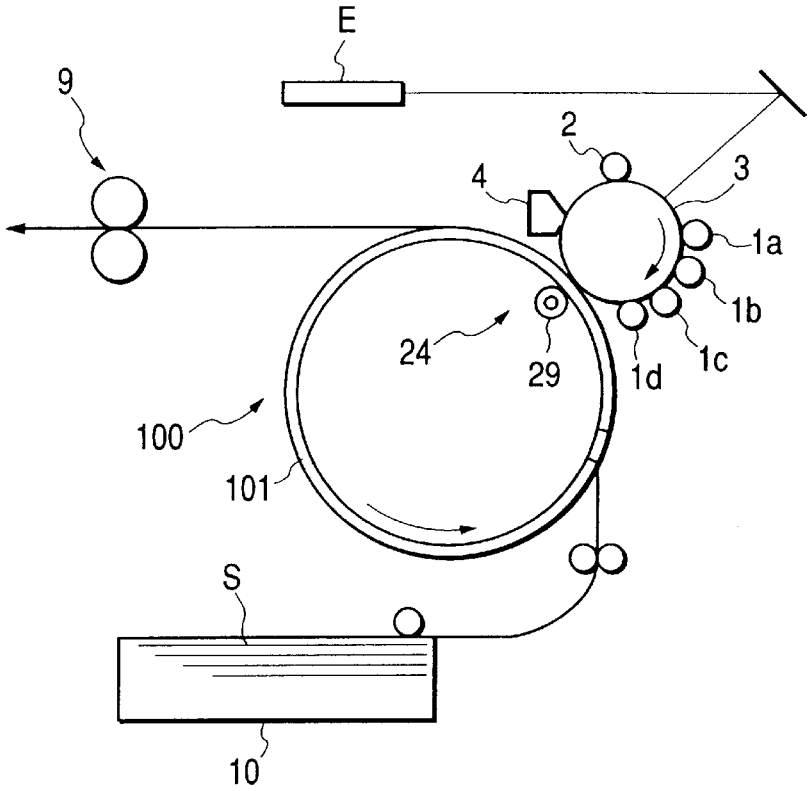
FIG. 12 is a schematic configurational view in the case where the present invention is applied to an image forming apparatus using a transfer drum.

First, FIG. 12 shows a schematic configuration of a case where the present invention is applied to an image forming apparatus using a transfer drum.

The image forming apparatus of FIG. 12 is operated as follows. That is, a surface of a drum-shaped electrophotographic photosensitive member (photosensitive drum) 3 as an image bearing member is uniformly charged by a charger 2, and the surface is then scanned for exposure with laser light by using an light exposure system E in accordance with color-separation image information to form an electrostatic latent image. For example, after an electrostatic latent image according to first color, cyan image information is formed on the photosensitive drum 3, a developing device 1*a* containing a cyan developer (including toner) subsequently transfers and adheres cyan toner to an image forming portion of the electrostatic latent image to visualize the latent image, whereby a cyan toner image can be formed on the photosensitive drum 3.

On the other hand, a recording material S contained in a recording material cassette 10 is attracted to a transfer drum 100 opposed to the photosensitive drum 3 and is fed to a transfer portion which is an opposed portion to the photosensitive drum 3 in such a manner that it is synchronized to the formation of the first color toner image on the photosensitive drum 3.

The transfer drum 100 is formed by adhering a sheet-shaped transfer sheet 101 used as a recording material bearing member to a frame to form a drum member. And a transfer roller 29 constituting transfer means 24 is brought into contact with the photosensitive drum 3 through the transfer sheet 101 in the transfer portion.

Thus, a toner image on the photosensitive drum 3 is electrostatically transferred to the feeding recording material S by the action of the transfer means 24, and subsequently, the transfer drum 100 is rotated while bearing the recording material S.

After that, when toner images of second color and the remaining colors (magenta, yellow and black) are multi-transferred on the same recording material S in the same way as described above, the recording material S is separated from the transfer drum 100 and is sent to a fixing device 9. Then, a toner image to be fixed is fixed to the recording material S by heat and pressure and a full colored image can be finally formed.

The recording material S on which the full colored image was formed is then discharged outside the image forming apparatus. Further, after transfer, the residual untransferred toner and the like adhered to the photosensitive drum 3 are removed by a cleaner 4, whereby the repeated image formation becomes possible.

In the transfer portion of thus configured image forming apparatus, a sufficient transfer efficiency can be obtained by setting a partial voltage of the transfer means 24 during transfer to a level larger than a partial voltage of the transfer sheet 101 used as a recording material bearing member as in the above-mentioned Embodiments 1 to 3, for example when an image is formed on post cards left under low humidity circumstances as well as when an image is formed on an if image formable recording material of the maximum size. Further no transfer memory on the photosensitive drum 3 due to excess current to a non-passing portion is generated. Further, other effects described in Embodiment 1 can also be obtained.

Figure 13:
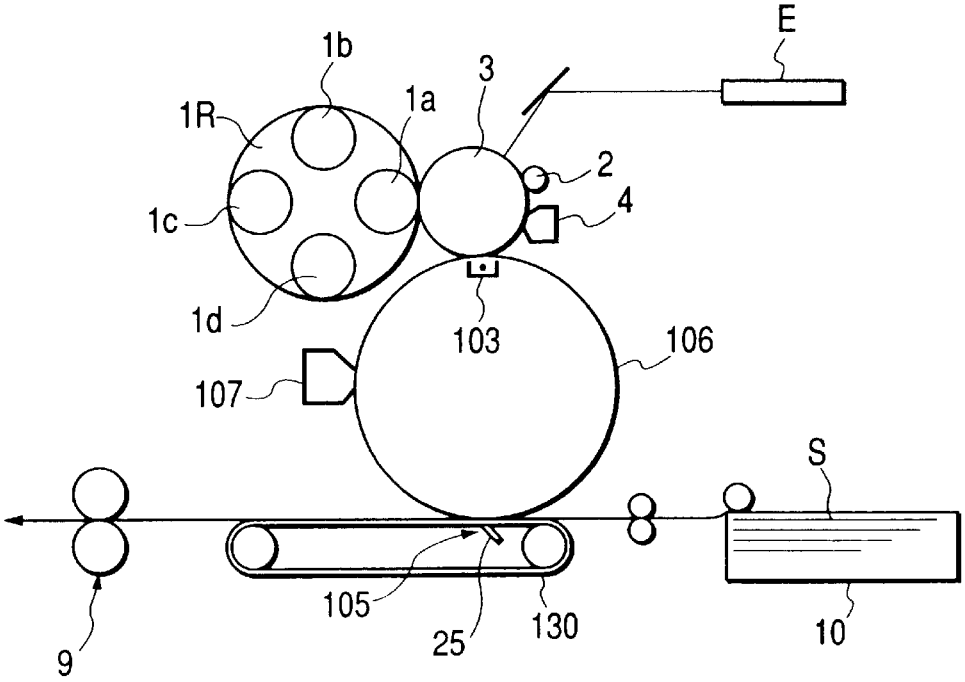
FIG. 13 is a schematic configurational view in the case where the present invention is applied to an image forming apparatus using an intermediate transfer member.

Next, a case where the present invention is applied to an image forming apparatus including an intermediate transfer member will be described. FIG. 13 shows a schematic configuration of a case where the present invention is applied to an image forming apparatus using an intermediate transfer member.

The image forming apparatus of FIG. 13 is operated as follows. That is, a surface of a drum-shaped electrophotographic photosensitive member (photosensitive drum) 3 as an image bearing member is uniformly charged by a charger 2, and the surface is then scanned for exposure with laser light by using an light exposure system E in accordance with color-separation image information to form an electrostatic latent image. After that, by rotation of a developing device rotary 1R provided in the vicinity of a photosensitive drum 3, for example, a cyan developing device 1*a* for a first color provided in this developing device rotary 1R is opposed to the photosensitive drum 3 and a cyan developer (including toner) contained in the cyan developing device 1*a* is transferred and adhered to an image forming portion of the electrostatic latent image to visualize the image, whereby a toner image is formed.

The cyan toner image formed on the photosensitive drum 3 is then primarily transferred to an intermediate transfer drum 106 which is used as an intermediate transfer member provided so as to be opposed to the photosensitive drum 3 by action of a primary transfer charger 103 which is used as primary transfer means.

Subsequently, toner images for a second color and the remaining colors (magenta, yellow and black) are sequentially formed on the photosensitive drum 3 in the same way as described above and multiple transfer is sequentially performed on the intermediate transfer drum 106.

The recording material S is then fed from a recording material cassette 10 in synchronism with the multiple transfer of four colored toner images on the intermediate transfer drum 106 and the recording material S is fed to a secondary transfer portion in which secondary transfer means 105 including a transfer blade 25 made of a conductive rubber material as in Embodiment 1 is brought into contact with the intermediate transfer drum 106 through a transfer belt 130 which is a recording material bearing member as in Embodiment 1.

In the secondary transfer portion, the four color-superimposed toner images formed on the intermediate transfer drum 106 are electrostatically, collectively and secondarily transferred on the recording material S by action of the transfer blade 25. After that the recording material bearing toner images to be fixed is fed to a fixing device 9 and the toner images to be fixed are fixed to the recording material S by heat and pressure. The recording material on which full color images were formed by fixing is then discharged outside the image forming apparatus.

Further, the photosensitive drum 3 which has finished the primarily transfer of the respective colored toner images and the intermediate transfer drum 106 which has finished the secondary transfer are subjected to cleaning of toner and the like remaining after transfer with cleaners 4 and 107 respectively and provided for image formation repeatedly.

Thus, in the image forming apparatus for forming images on the recording material S through the intermediate transfer member, a sufficient transfer efficiency can be obtained by setting a partial voltage of the secondary transfer means 105 to a level larger than a partial voltage of the transfer belt 130 during the secondary transfer as in the above-mentioned Embodiments 1 to 3, for example when an image is formed on post cards left under low humidity circumstances as well as when an image is formed on an image formable recording material of the maximum size. That is, the photosensitive drum 3 in the above-mentioned Embodiments 1 to 3 may be replaced with an intermediate transfer member.

As described above, according to the present invention, by setting the partial voltage of the transfer means to a level larger than the partial voltage of the recording material bearing member in the case where the recording material bearing member is a transfer sheet 101 which constitutes the transfer drum 100, and when the transfer portion is a secondary transfer portion from the intermediate transfer member (intermediate transfer drum 106) onto the recording material S, the resistance ratio between the passing portion and non-passing portion of the recording material S can be also decreased in the transfer portion (including the secondary transfer portion) even when image formation is carried out on a recording material of a size smaller than the largest possible size of the recording material for image formation. Therefore, an appropriate amount of charge can be stably provided on the recording material S in the image formation on the recording material S having a width equal to or less than the width of the largest possible size of the recording material for image formation without being influenced by the values of physical properties of the image bearing member, the recording material bearing member and the recording material which are always varied by, for example, the placement circumstances of the image forming apparatus and the circumstances in which the recording material S is left.

In Embodiments 1 to 4 described above, as a power supply a constant current power supply is used. The present invention works appropriately also when a constant voltage power supply which controls voltage to a desired voltage is used.

Further, detection of the width of the recording material S may be performed by an operator by inputting values from an operating portion (not shown) of the main body of the image forming apparatus, a host computer, or the like, and may be automatically determined by a mechanical sensor or an optical sensor.

Figure 5:
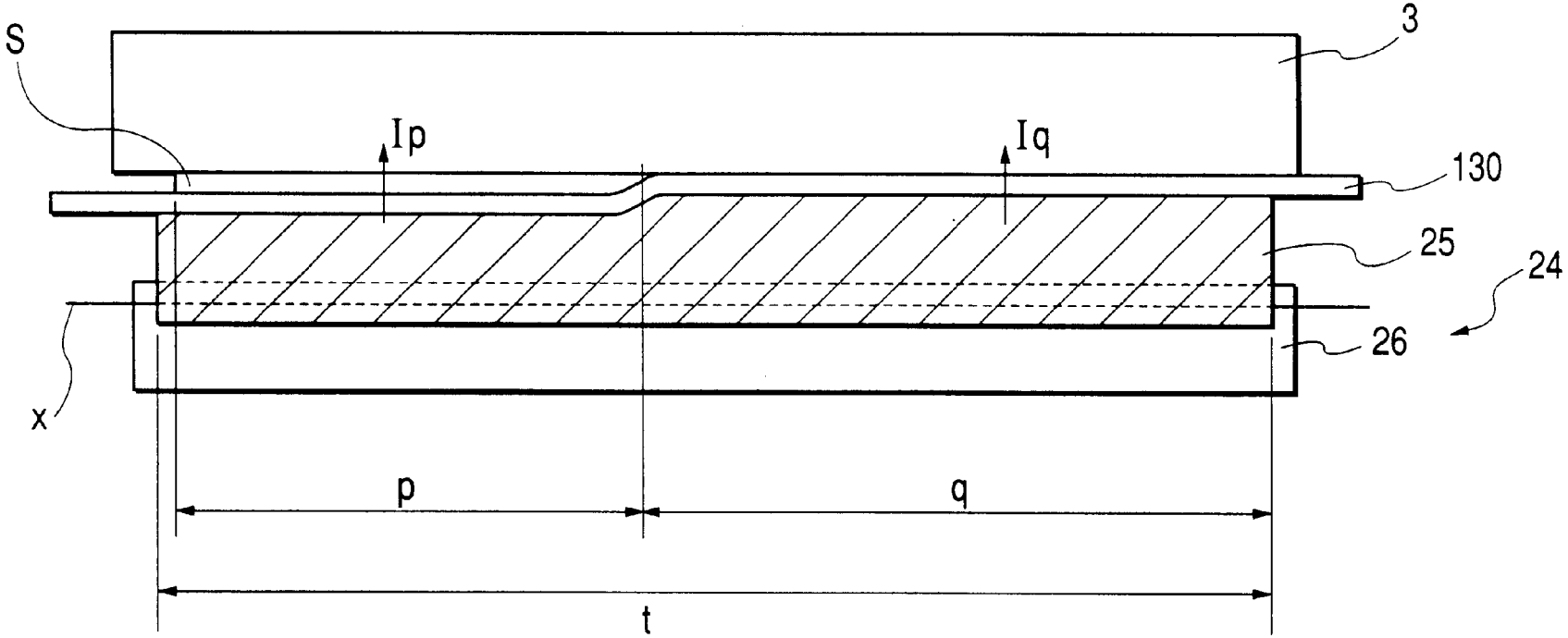
FIG. 5 is a cross-sectional view of a transfer portion when a recording material of a small size is passed.
Figure 6:
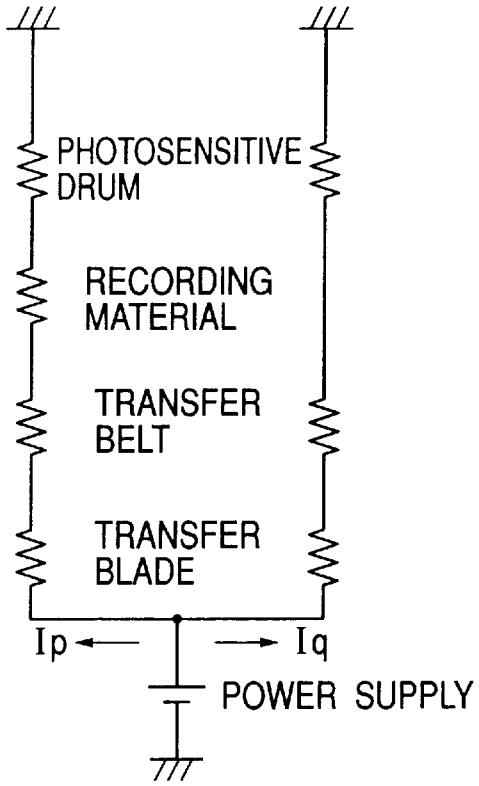
FIG. 6 is a view showing an equivalent circuit of the transfer portion of FIG. 5.

Further, in the above-mentioned respective embodiments, the recording material S is positioned on the recording material bearing member by abutting the side edge of the recording material S against a reference plate as shown in FIG. 5, that is, the recording material S is borne by using the left edge of the transfer belt 130 as the reference. However, the center of the transfer belt 130 in the thrust direction may also be used as the reference.

In the above-mentioned respective embodiments, an image forming apparatus using an electrophotographic photosensitive member (photosensitive drum 3) as an image bearing member is described. However, the present invention is not limited to this and, for example, a dielectric member in an electrographic recording system may also be used as the image bearing member.

Methods of developing electrostatic latent images on an image bearing member are roughly divided into four types. Of the four types of methods, two types use mono-component developer and the other two types use two-component developer. The first two types using mono-component developer consist of (1) a mono-component non-contact developing method in which developing is performed in a non-contact state on an image bearing member and (2) a mono-component contact developing method in which developing is performed in a contact state on an image bearing member. Both of the first two types use generally, as the mono-component developer, non-magnetic toner which is applied by a blade or the like to a sleeve serving as a developer bearing member provided in a developing device and is fed, or magnetic toner which is applied by magnetic force to the sleeve and is fed. Further, the latter two types using two-component developer consist of (3) a two-component contact developing method in which developing is performed in a contact state on an image bearing member and (4) a two-component non-contact developing method in which developing is performed in a non-contact state on an image bearing member. Both of the latter two types use as the developer a two-component developer which is made by mixing toner particles and magnetic carriers and is fed by magnetic force. In the present invention, any method described above may be used as developing methods. Nevertheless, two-component contact developing method is well used from viewpoints of high image quality and high stability of images.

Furthermore, the image forming apparatuses of the above-mentioned embodiments, each have a configuration in which image formation can be performed on both sides of the recording material. That is an image is transferred to a first surface (side) of the recording material, and the transferred image is fixed to the first surface thereof by heating and pressurizing it with a fixing device. After that, the recording material is fed to a surface reverse tray 65 through a surface reverse path. Then the recording material is again sent to an image forming portion and to fixing portion to thereby transfer and fix an image to a second surface (back surface) at desired timing, and the recording material is then discharged outside the apparatus.

As described above, the present invention is particularly effective for image transfer to the second surface of the recording material of a small size which is low in humidity due to the fixing step.

What is claimed is:

1. An image forming apparatus, comprising:

an image bearing member for bearing an image;

image forming means for forming images of a plurality of colors on said image bearing member;

a recording material bearing member for bearing and feeding a recording material;

a transfer member brought into contact with a back surface of said recording material bearing member to induce charges to said recording material bearing member so that an image on said image bearing member is electrostatically transferred to the recording material; and constant-current-controlling means for controlling a power supply so that a predetermined electric current is supplied to said transfer member, wherein the images of the plurality of colors formed on said image bearing member are sequentially superimposed on the recording material borne by said recording material bearing member, and wherein the following relationship is held:

$$900 \leqq V \cdot (S \cdot L)/I \leqq 4500 (\mathrm{kV \cdot mm^2/\mu C})$$

where

I ($\mu$C/sec.) denotes said predetermined electric current,

V (kV) denotes an applied voltage of said power supply when said predetermined electric current I is supplied, S (mm/sec.) denotes a movement speed of said recording material bearing member, and L (mm) denotes a length of said transfer member in a direction perpendicular to a feeding direction of the recording material.

2. An image forming apparatus according to claim 1, wherein an impedance of said transfer member is larger than an impedance of said recording material bearing member.

3. An image forming apparatus according to claim 1, wherein said length L of said transfer member is larger than a length of the recording material in the direction perpendicular to the feeding direction of the recording material.

4. An image forming apparatus according to claim 1, wherein said transfer member is a blade.

5. An image forming apparatus according to claim 1, wherein said transfer member is a roller.

6. An image forming apparatus according to claim 1, wherein said transfer member is a brush.

7. An image forming apparatus according to claim 1, further comprising fixing means for fixing an image transferred on the recording material, wherein after an image transferred on a first surface of the recording material is fixed, an image on said image bearing member can be transferred onto a second surface opposite to the first surface of the recording material.

8. An image forming apparatus according to claim 1, comprising:

a plurality of image bearing members for bearing the images of the plurality of colors; and a plurality of transfer members for sequentially transferring the images from said plurality of image bearing members to the recording material borne by said recording material bearing member.

* * * * *

UNITED STATES PATENT AND TRADEMARK OFFICE

CERTIFICATE OF CORRECTION

PATENT NO. : 6,487,380 B1
DATED : November 26, 2002
INVENTOR(S) : Yoshikuni Ito

It is certified that error appears in the above-identified patent and that said Letters Patent is hereby corrected as shown below:

Column 1,
Line 13, “have” should read -- have been --;
Line 18, “forking” should read -- forming --;
Line 25, “so called a” should read -- a so called --; and
Line 34, “inform-” should read -- form- --.

Column 3,
Lines 25 and 28, “is” should read -- are --.

Column 7,
Line 66, “under the all” should read -- under all the --.

Column 9,
Line 31, “inconsideration” should read -- in consideration --.

Column 10,
Line 16, “.transfer” should read -- transfer --.

Column 14,
Line 60, “so called a” should read -- a so called --.

Column 16,
Line 45, “primarily” should read -- primary --.

Signed and Sealed this

Seventh Day of October, 2003

JAMES E. ROGAN
*Director of the United States Patent and Trademark Office*